United States Patent [19]

Nino

[11] Patent Number: 4,885,669

[45] Date of Patent: Dec. 5, 1989

[54] HEADLIGHT DEVICE FOR VEHICLE

[75] Inventor: Naohi Nino, Shimizu, Japan

[73] Assignee: Koito Seisakusho Co., Ltd., Shizuoka, Japan

[21] Appl. No.: 263,579

[22] Filed: Oct. 26, 1988

[51] Int. Cl.[4] ..... F21V 7/00

[52] U.S. Cl. ..... 362/346; 362/80

[58] Field of Search ..... 362/61, 80, 346

[56] References Cited

U.S. PATENT DOCUMENTS

| | | | |
|---|---|---|---|
| 4,100,594 | 7/1978 | Gould . | |
| 4,208,704 | 6/1980 | Draper | 362/61 |
| 4,456,948 | 6/1984 | Brun | 362/61 |
| 4,481,563 | 11/1984 | Snyder et al. | 362/346 |
| 4,498,124 | 2/1985 | Mayer et al. | 362/61 |
| 4,511,955 | 4/1985 | Ernst et al. . | |
| 4,517,630 | 5/1985 | Dieffenbach et al. . | |
| 4,523,262 | 6/1985 | Shinkai | 362/61 |
| 4,654,758 | 3/1987 | Székacs | 362/61 |
| 4,680,679 | 7/1987 | Dilouya | 362/61 |
| 4,697,225 | 9/1987 | Lindae et al. . | |
| 4,704,661 | 11/1987 | Kosmatka | 362/61 |
| 4,772,987 | 9/1988 | Kretschmer et al. | 362/61 |

*Primary Examiner*—Stephen F. Husar

*Attorney, Agent, or Firm*—Sughrue, Mion, Zinn, Macpeak & Seas

[57] ABSTRACT

A headlight device for use in a vehicle and comprising a reflective mirror which is divided into a first portion being effective to form a light distrbution pattern of the central portion, and a second portion being effective to form a light distribution pattern of the left and right side portions.

7 Claims, 21 Drawing Sheets

HEADLIGHT DEVICE FOR VEHICLE

FIELD OF THE INVENTION

The present invention relates to a headlight device for a vehicle such as an automobile and the like and, particularly to a novel headlight device adapted for that having a reduced dimension in the vertical directions and that being inclined in the upper and rear directions.

DESCRIPTION OF PRIOR ART

Various headlights have been proposed and utilized, and recently, according to the design of the automobile, the height or the vertical dimension of the headlight is reduced in some cases, and/or the lens of the headlight is excessively inclined in the upper and rear directions.

When the vertical dimension of the lens is reduced, it is difficult to maintain the amount of the light passing through the lens in the vertical directions, and to control the light beam in the vertical direction, thus, it is difficult to obtain desired light distribution.

Further, when the lens is inclined, the light passing through the lens is adversely affected thereby, thus, the headlight should have the characteristics for compensating the inclination of the lens.

SUMMARY OF THE INVENTION

An object of the invention is to solve the problems above mentioned and, according to the invention, there is provided a headlight device wherein the reflective mirror is divided into a part effective to form the light distribution pattern of the central portion and a part effective to form the light distribution pattern of left and right side portions.

Thus, according to the invention, the light distribution pattern is determined mainly by the reflective mirror, and the role of the lens decreases, so that the design of the lens can be simplified.

BRIEF DESCRIPTION OF THE DRAWINGS

Further objects and advantages of the invention will become apparent from the following detailed description in conjunction with accompanying drawings, in which.

DETAILED DESCRIPTION OF PREFERRED EMBODIMENTS

Figure 1:
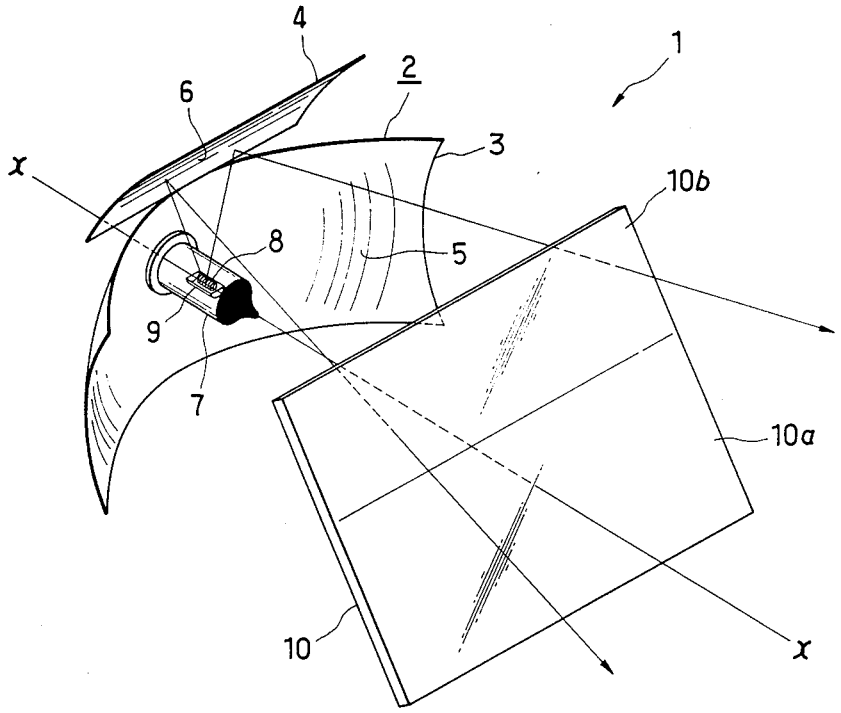
FIG. 1 is a schematic perspective view of a headlight device according to one embodiment of the invention.
Figure 2:
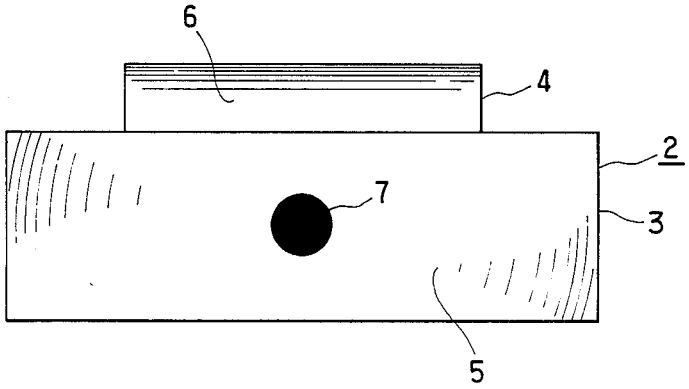
FIG. 2 is a front view of the reflective mirror of the embodiment of FIG. 1.
Figure 3:
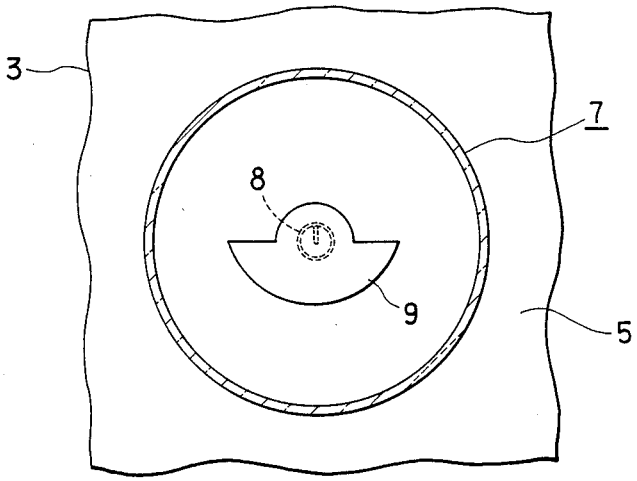
FIG. 3 is a partially broken enlarged front view of the embodiment of FIG. 1.
Figure 4:
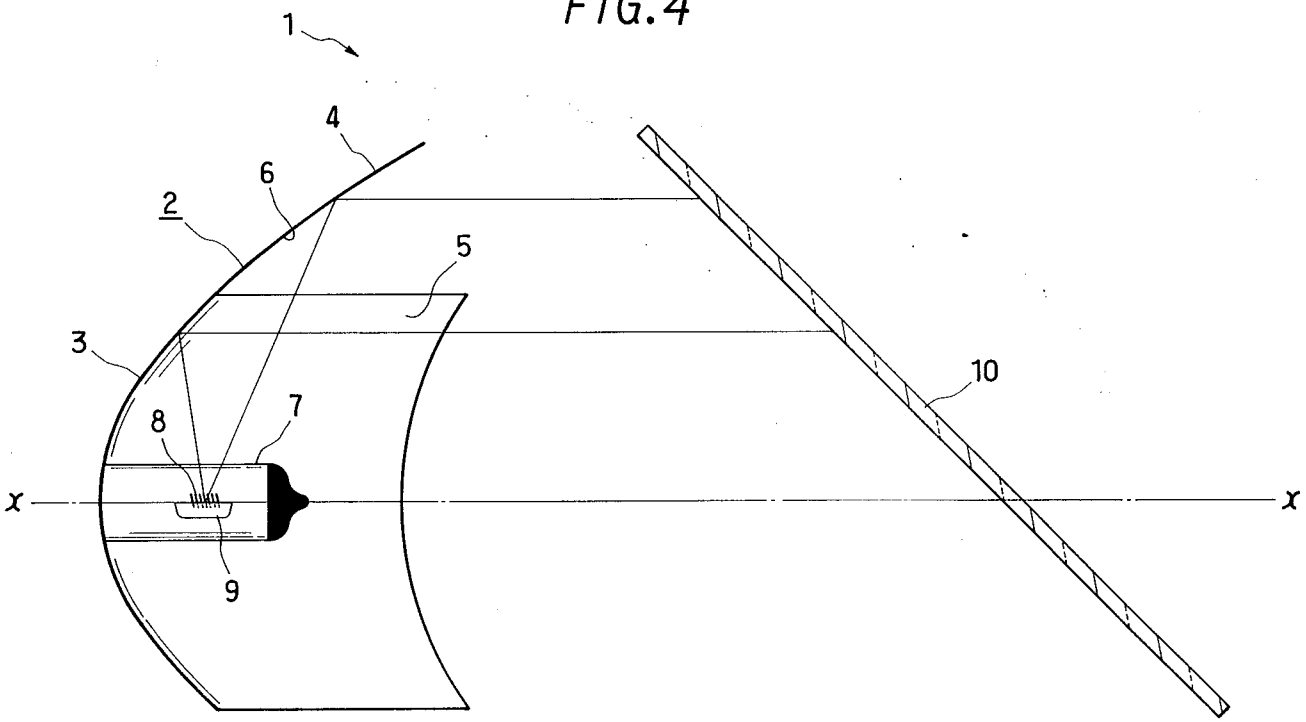
FIG. 4 is a longitudinal sectional view of the headlight device of FIG. 1.
Figure 5:
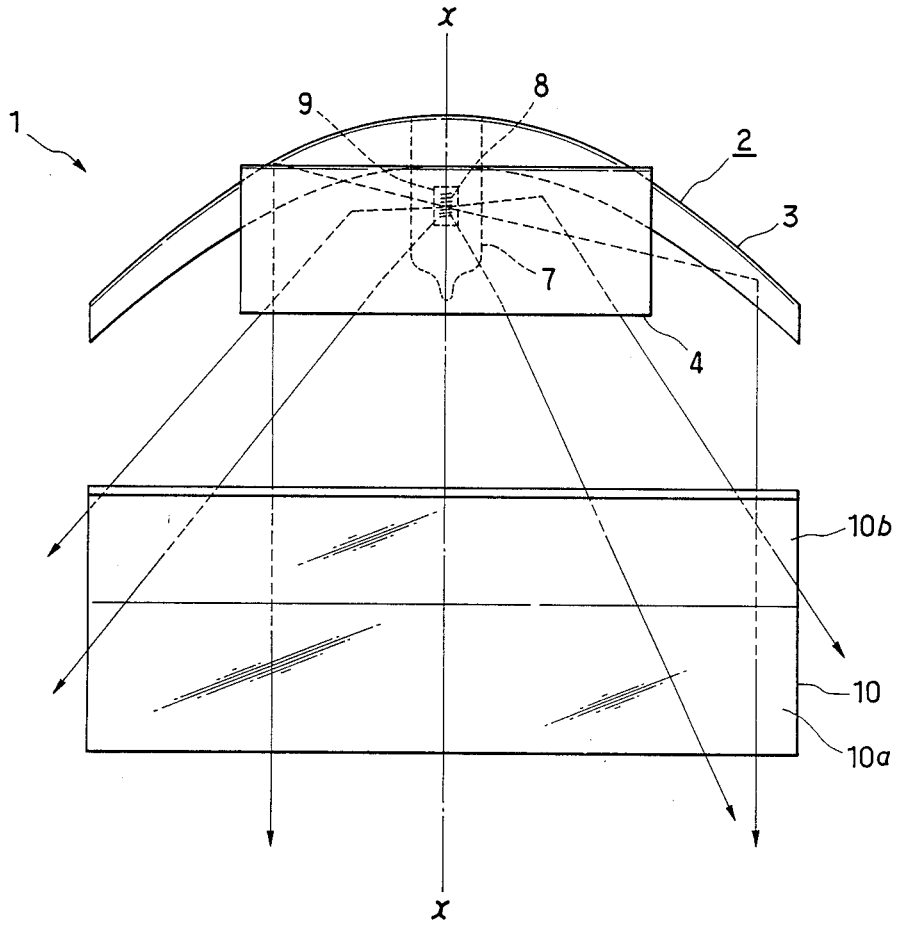
FIG. 5 is a plan view of the headlight device of FIG. 1.

FIG. 1~FIG. 6 show a headlight device 1 according to a first embodiment of the present invention, which comprises a reflective mirror 2 consisting of a first reflective mirror portion 3 and a second reflective mirror portion 4.

The first mirror portion 3 mainly acts to form the central portion of the light distribution pattern and has a reflective surface 5 of the shape of paraboloid of rotation. The second reflective mirror portion 4 acts to form a transversely extending portion of the light distribution pattern, and has a reflective surface 6 of the shape of ship-like shaped paraboloid. It will be noted that the wording ship-like shaped paraboloid means that the surface has the shape of paraboloid in one cross-section and that of a straight line in the cross-section perpendicular to the one cross-section. The surface 6 of the second reflective mirror portion 4 has the shape of paraboloid in the vertical cross-section, and the shape of a straight line in the horizontal cross-section. The line of focus of the reflective surface 6 of the second reflective mirror portion 4 passes through the focus of the reflective surface 5 of the first reflective mirror portion 3.

An electric bulb 7 is mounted on the central portion of the first reflective mirror portion 3, and has a filament 8. The filament 8 is arranged slightly forward of the common focus of the reflective surfaces 5 and 6 and along the optical axis x—x.

Shown at numeral 9 in FIGS. 1, 3, 4 and 5 is a shade for covering the lower half and the front side of the filament 8.

A lens 10 is mounted in front of the reflective mirror 2, and is inclined in forward and downward direction. The lens 10 consists of a portion 10*a* facing the first reflective mirror portion 3 and having a plurality of steps for controlling the light passing therethrough, and a portion 10*b* facing the second reflective mirror portion 4 and not having the steps substantially.

Figure 6:
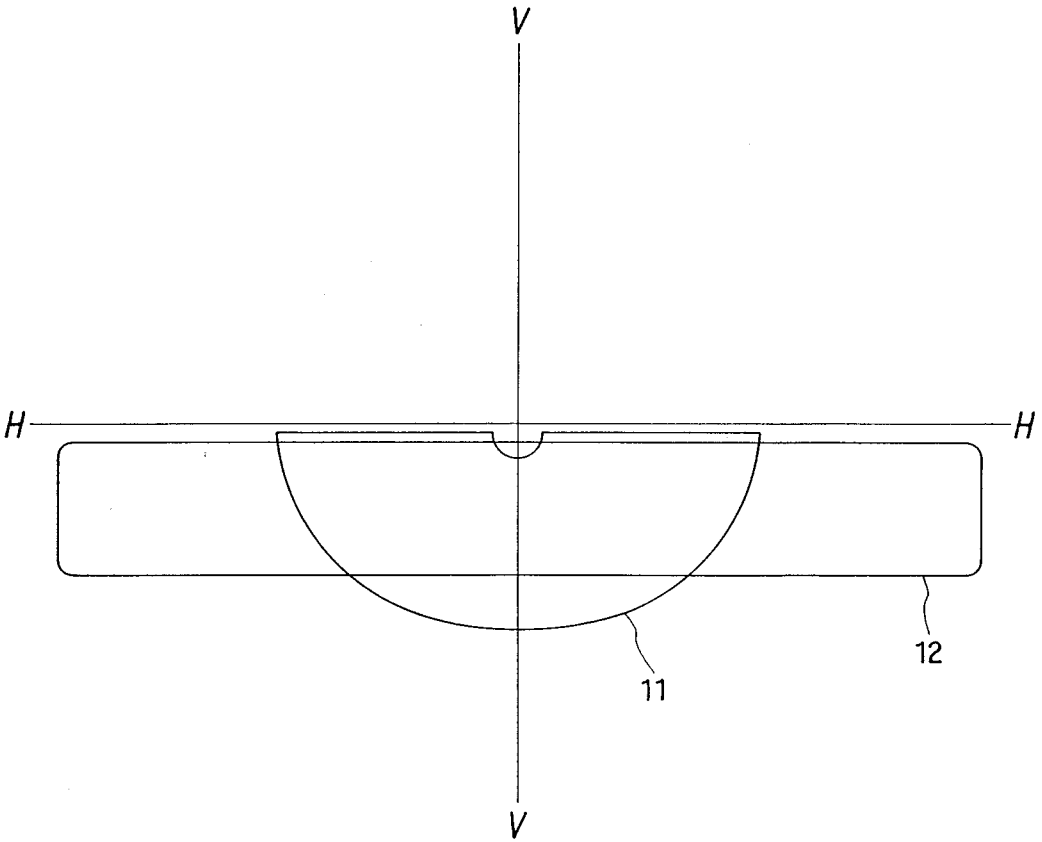
FIG. 6 is a view showing the light distribution pattern of the headlight device iof FIG. 1.

The light distribution pattern obtained from the reflective mirror 2 is shown in FIG. 6. In FIGS. 6, 8, 12, 13, 16, 19, 21, 24 and 25, line H—H is a horizontal line perpendicular to the optical axis x—x of the reflective mirror, and line V—V is a vertical line perpendicular to the optical axis x—x of the reflective mirror.

The reflective surface 5 of the first reflective mirror portion 3 has the shape of paraboloid of rotation and the filament 8 is located in front of the focus of the surface 5 with the lower half being covered by the shade 9, thus, the reflective surface 5 acts to form a portion 11 of the light distribution pattern of FIG. 6. The portion 11 mainly forms the central portion of the pattern. And the reflective surface 6 of the second reflective mirror portion 4 has the shape of ship-like shaped paraboloid, thus, the reflective surface 6 acts to form a portion 12 of the light distribution pattern, since the light reflected by the surface 6 does not substantially diverge in the vertical directions. The portion 12 mainly acts to form the side portions of the light distribution pattern.

As shown in FIG. 6, the light distribution pattern obtained by portions 11 and 12 is similar to desired light distribution pattern as that of the headlight of an automobile, thus, the lens 10 is not usually required to have excessively large controlling function.

Figure 7:
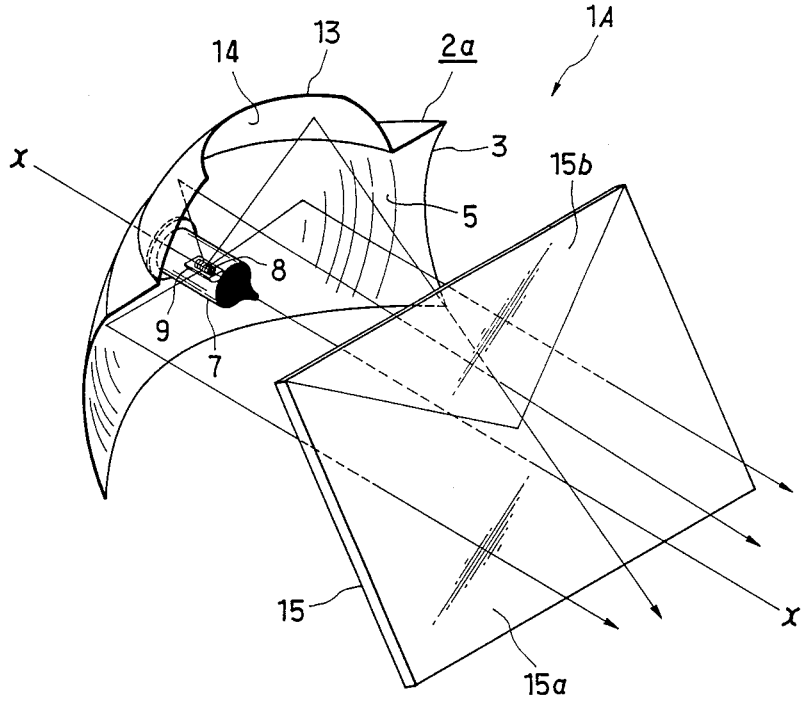
FIG. 7 is a schematic perspective view of a headlight device according to a second embodiment of the invention.
Figure 8:
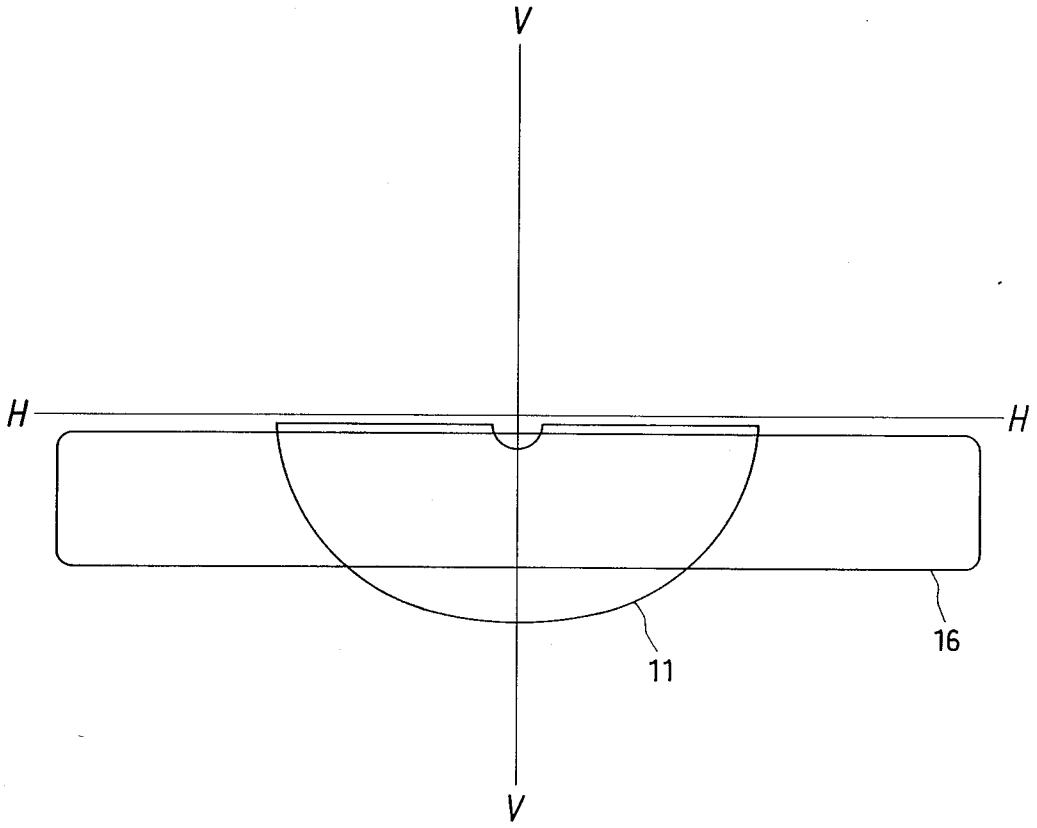
FIG. 8 is a view showing the light distribution pattern of the headlight device of FIG. 7.
Figure 9:
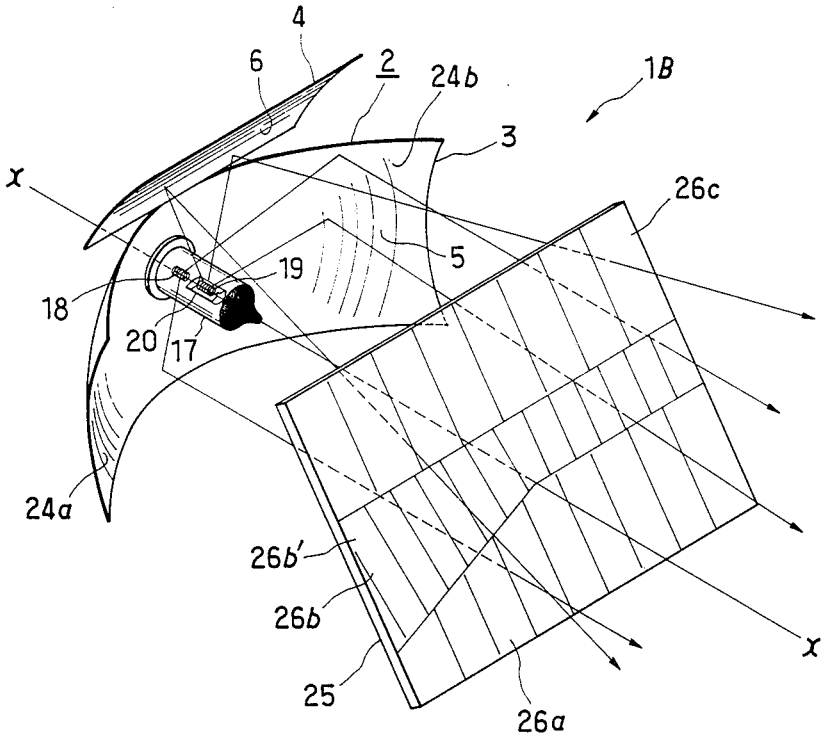
FIG. 9 is a schematic perspective view of a headlight device according to a third embodiment of the invention.
Figure 10:
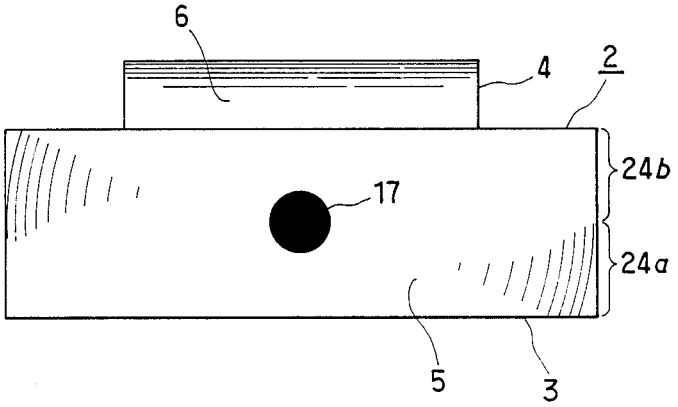
FIG. 10 is a front view of the reflective mirror of the embodiment of FIG. 9.
Figure 11:
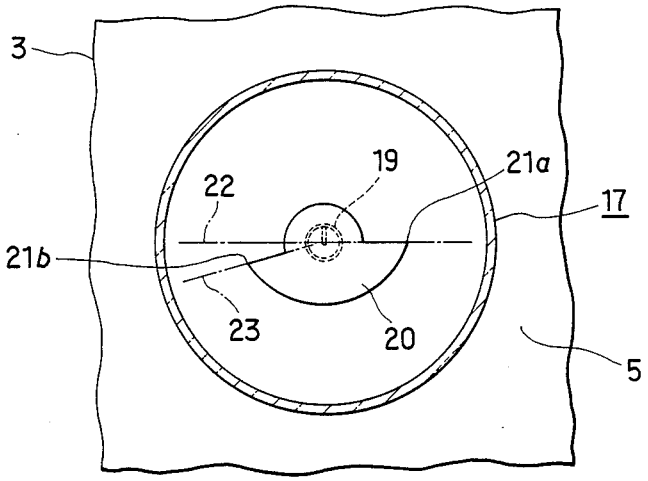
FIG. 11 is a partially broken enlarged front view of the embodiment of FIG. 9.

FIGS. 7 and 8 show a headlight 1A according to the second embodiment of the invention, which is similar to the first embodiment except for a second reflective mirror portion 13 of a reflective mirror 2*a* and for a lens 15.

The second reflective mirror portion 13 has a reflective surface 14 of the shape of combined parabola and ellipse. The shape of combined parabola and ellipse is a parabola in the vertical section and an ellipse in the horizontal section, and the focus of the parabola is on a first focus of the ellipse. Thus, when a light source is arranged on the focus, the light emitted from the light source and reflected at the reflective surface 14 forms a light beam parallel to the optical axis in the vertical direction and, in the horizontal direction, the light beam converges at the second focus of the ellipse and, thereafter, diverges.

The focus of the reflective surface 14 of the second reflective mirror portion 13 is located at the focus of the reflective surface 5 of the first reflective mirror portion 3.

A lens 15 disposed in front of the reflective mirror 2*a* is inclined downward and forward, and consists of a portion 15*a* corresponding to the first reflective mirror portion 3 and having lens steps for controlling the light, and a portion 15*b* corresponding to the second reflective mirror portion 13 and not having lens steps substantially.

The light distribution pattern of the headlight 1A obtained from the reflective mirror 2*a* is shown in FIG. 8. The light distribution pattern obtained from the first reflective mirror portion 3 is shown at numeral 11 in FIG. 8 and that of the second reflective mirror portion 13 is shown at numeral 16. Similar to the first embodiment, the controlling function of the lens 15 is usually relatively small.

FIG. 9 through FIG. 13 show a headlight 1B according to the third embodiment of the invention. The reflective mirror 2 of the first embodiment is utilized as the reflective mirror of the third embodiment. An electric bulb 17 is mounted on the central portion of the first reflective mirror portion 3, and has a main filament 18 for forming a driving beam or a high beam and a sub-filament 19 for forming a low beam. The filaments 18 and 19 are arranged before and after on the optical axis x—x with the main filament 18 being nearly at the focus of the reflective surfaces 5 and 6, and the sub-filament 19 being in front of the main filament 18.

A shade 20 covers the front surface and nearly the lower half of the filament 19. As shown in the front view of FIG. 11, the right shoulder 21*a* of the shade 20 is on the horizontal plane 22 which passes through the optical axis x—x, and the left shoulder 21*b* is on an inclined plane 23 which intersects with the horizontal plane 22 at the optical axis x—x and inclines in left and lower direction by about 15 degrees.

The light emitted from the sub-filament 19 is controlled by the shade 20 such that the light is not directed to nearly the lower half portion 24*a* of the reflective surface 5, and is reflected by nearly the upper half portion 24*b* of the reflective surface 5 and by the reflective surface 6 of the second reflective mirror portion 4.

A lens 25 is provided on the headlight 1B and has a portion 26*a* corresponding to the portion 24*a* of the reflective surface 5 of the first reflective mirror portion 3, a portion 26*b* corresponding to the portion 24*b* of the reflective surface 5 of the first reflective mirror portion 3, and a portion 26*c* corresponding to the second reflective mirror portion 4. On a left half portion 26*b* of the portion 26*b* as viewed from the front, there are provided a plurality of steps having a small angle of dispersion for dispersing the light passing through the lens in the rightward upper direction, and there are formed dispersing steps of relatively small angle of dispersion in the left and right directions on remaining portion of the portion 26*b*, the portion 26*a* and the portion 26*c*.

Figure 12:
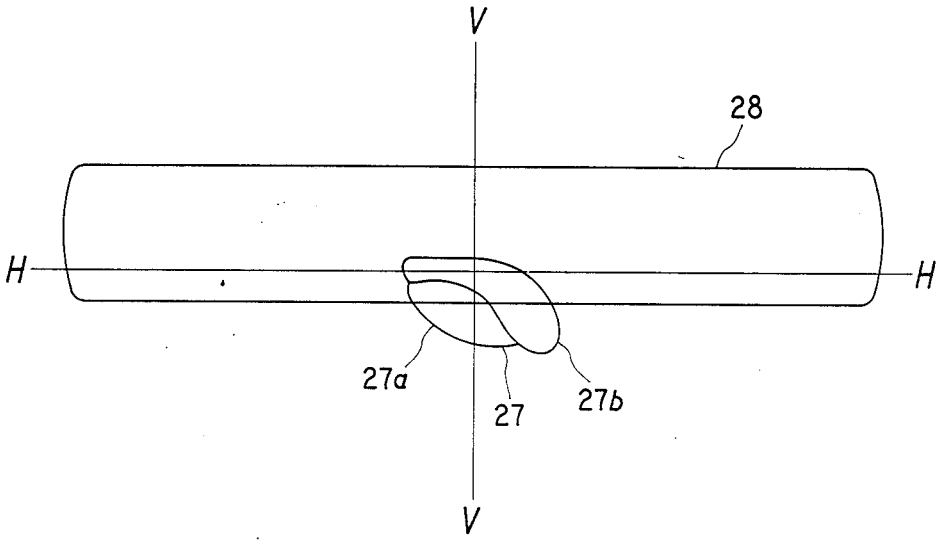
FIG. 12 is a view showing the light distribution pattern of the headlight device of FIG. 9.
Figure 13:
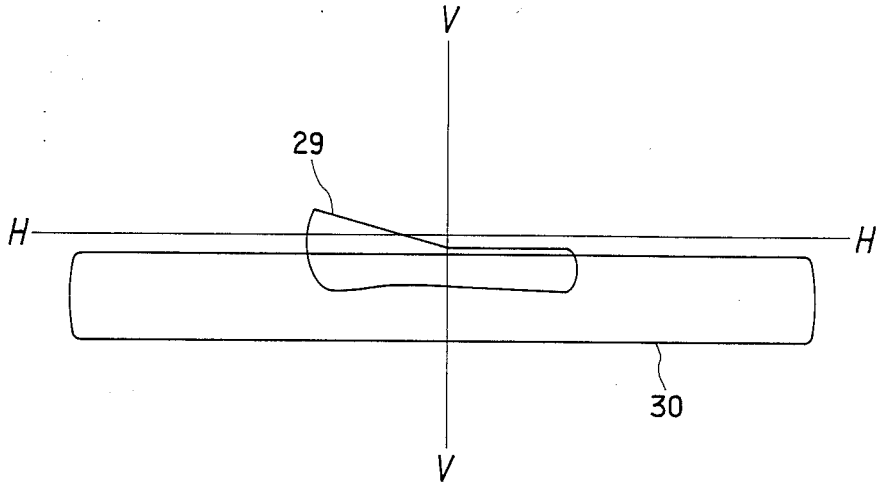
FIG. 13 is a view showing the light distribution pattern of a modified form of FIG. 12.

The light distribution pattern of the reflective mirror 2 of the third embodiment is shown in FIGS. 12 and 13. FIG. 12 shows the light distribution pattern of the main filament 18. A pattern 27 in FIG. 12 is obtained by the reflective surface 5 of the first reflective mirror portion 3, wherein a portion 27*a* is obtained from the lower portion 24*a* of the reflective surface 5, and a portion 27*b* is obtained from the upper portion 24*b* of the reflective surface 5. A pattern 28 in FIG. 12 is obtained from the reflective surface 6 of the second reflective mirror portion 4.

FIG. 13 is the light distribution pattern when the sub-filament 19 is lit. A pattern 29 in FIG. 13 is obtained from the upper portion 24*b* of the reflective surface 5 of the first reflective mirror portion 3, and a light distribution pattern 30 is that of the reflective surface 6 of the second reflective mirror portion 4.

Thus, according to the third embodiment 1B, only by the reflective mirror 2, it is possible to obtain the light distribution pattern of FIG. 12 which is similar to that of the driving beam or high beam of usual motor vehicles and the light distribution pattern of FIG. 13 which is similar to that of the low beam of usual motor vehicles.

Figure 14:
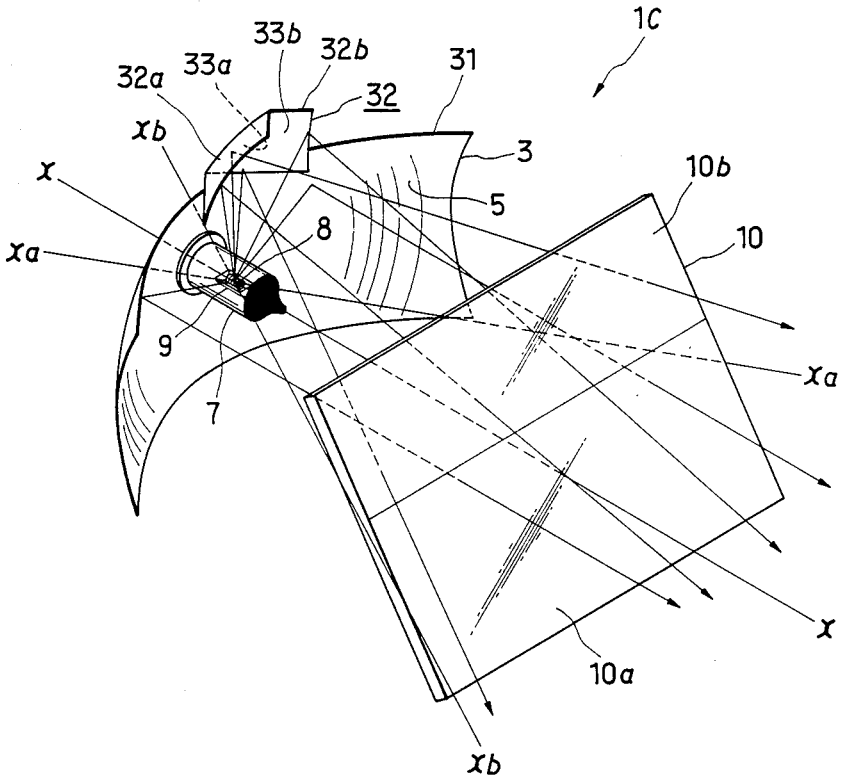
FIG. 14 is a schematic perspective view of a headlight device according to a fourth embodiment of the invention.
Figure 15:
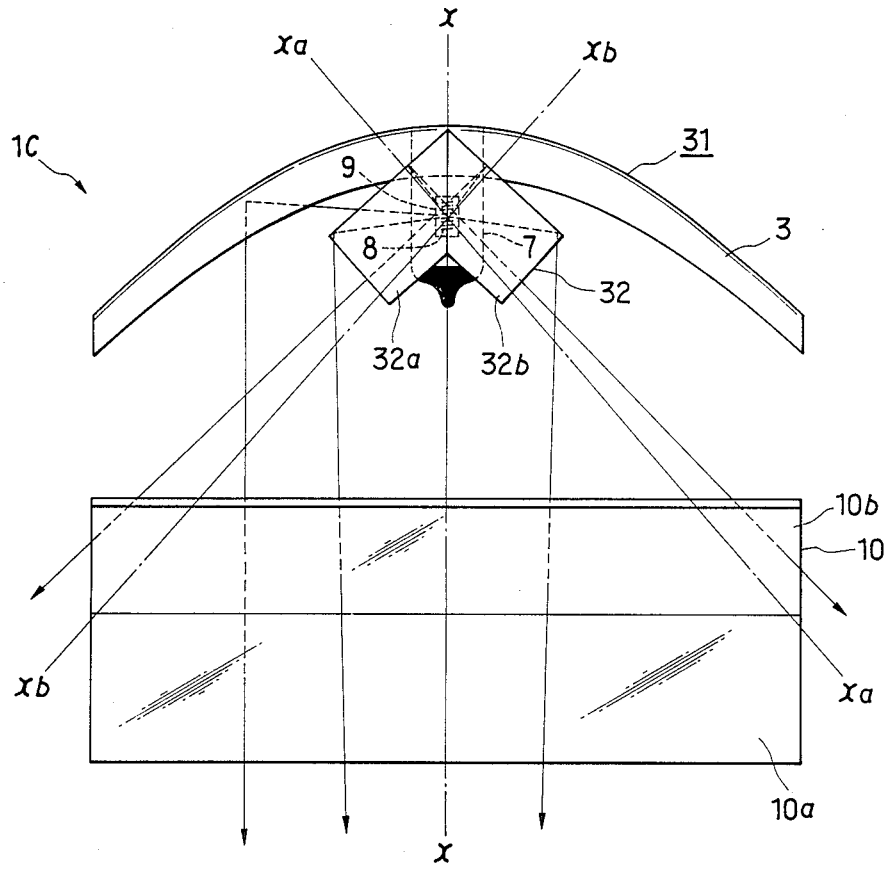
FIG. 15 is a plan view of the embodiment of FIG. 14.
Figure 16:
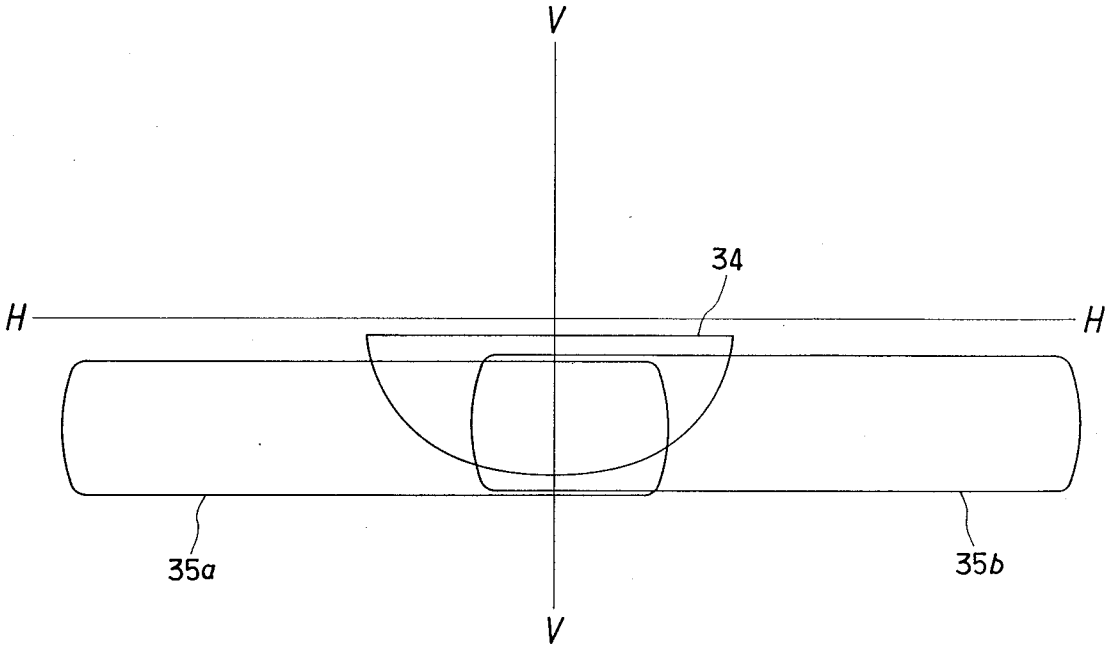
FIG. 16 is a view showing the light distribution pattern of the headlight device of FIG. 14.

FIG. 14 through FIG. 16 show the fourth embodiment 1C of the present invention. A reflective mirror 31 of the fourth embodiment comprises a first reflective mirror portion 3 having a reflective surface 5 of paraboloid of rotation (generally similar to the first embodiment), and a second reflective mirror portion 32. The second reflective mirror portion 32 consists of left and right portions 32a and 32b, which haverespectively reflective surfaces 33a and 33b of ship-like shaped paraboloid. The focus of the paraboloid of each of the reflective surfaces 33a and 33b intersects with each other at the focus of the reflective surface 5 of the first mirror portion 3, and the optical axis $X_a$—$X_a$ of the reflective surface 33a intersects the optical axis $X_b$—$X_b$ of the reflective surface 33b.

Similar to the first embodiment, an electric bulb 7 is mounted on the central portion of the first reflective mirror portion 3, and has a filament 8 on the optical axis x—x of the reflective surface 5 of the first mirror portion 3 and slightly forward of the focus thereof.

The reflective mirror 31 of the fourth embodiment makes a light distribution pattern as shown in FIG. 16. and, which comprises a portion 34 formed by the first reflective mirror portion 3, a portion 35a formed by the left side portion 32a of the second reflective mirror portion 32 and a portion 35b formed by the right side portion 32b of the second reflective mirror portion 32.

According to the fourth embodiment, since the second reflective mirror portion 32 is formed of the left and right portions 32a and 32b and the optical axes $x_a$—$x_a$ and $x_b$—$x_b$ intersect with one another, the light distribution patterns 35a and 35b are expanded widely.

Figure 17:
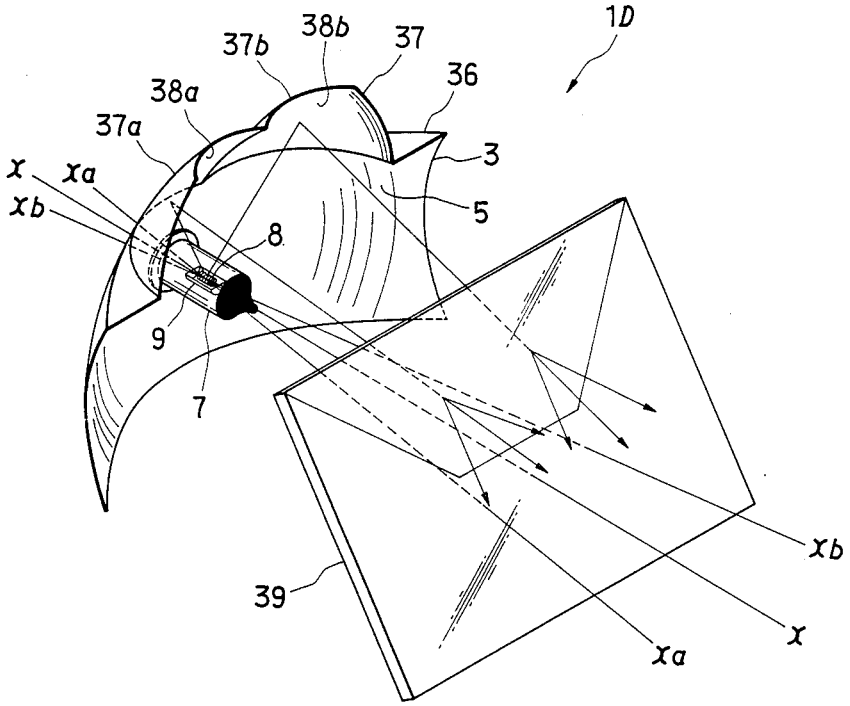
FIG. 17 is a schematic perspective view of a headlight device according to a fifth embodiment of the invention.
Figure 18:
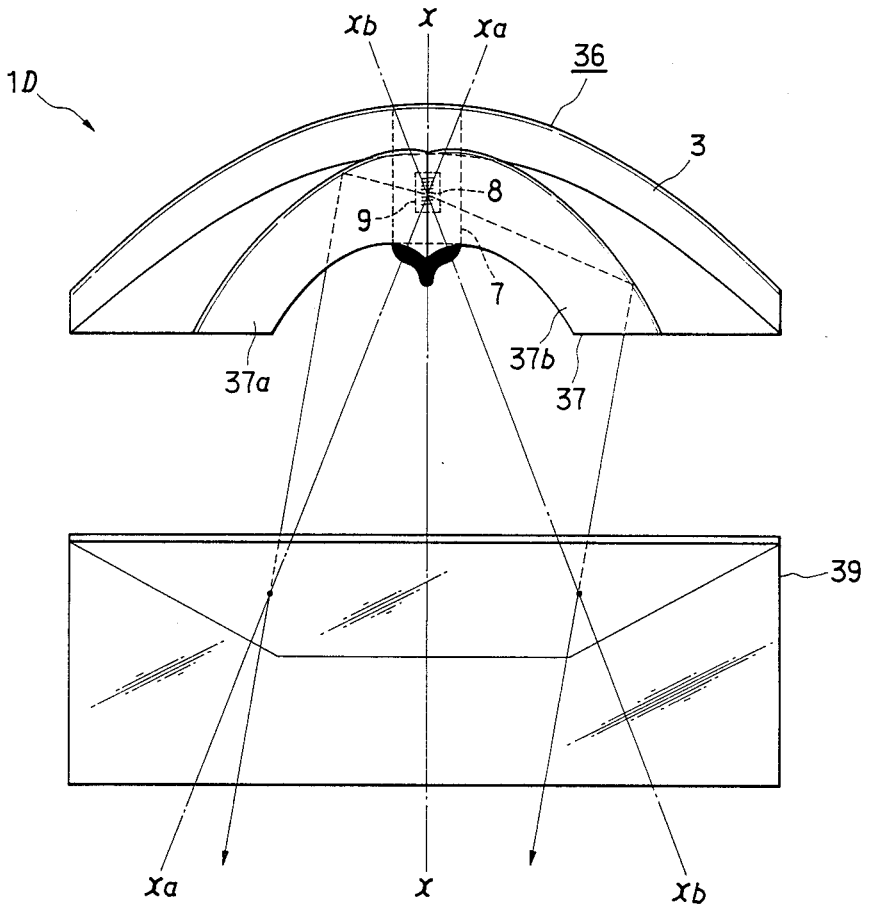
FIG. 18 is a plan view of the embodiment of FIG. 17.
Figure 19:
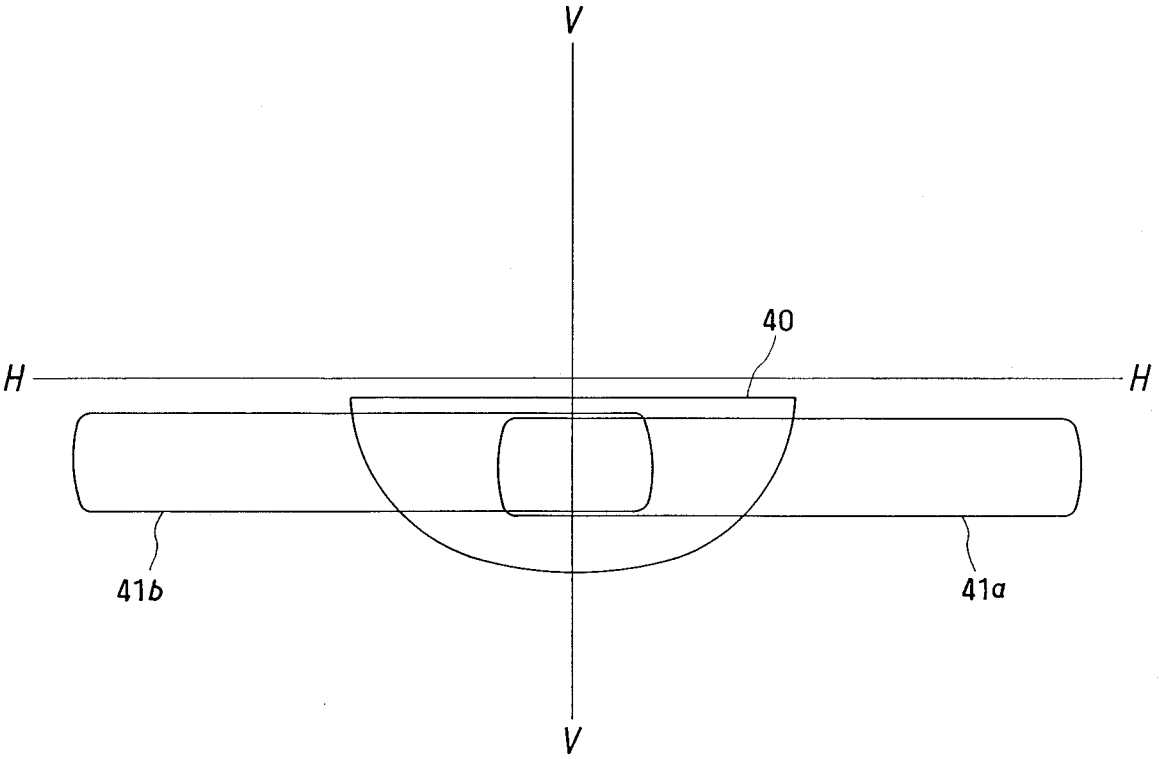
FIG. 19 is a view showing the light distribution pattern of the headlight device of FIG. 17.

FIG. 17 through FIG. 19 show the fifth embodiment 1D of the invention, which comprises a first reflective mirror portion 3 having a reflective surface 5 similar to the first embodiment, and a second reflective mirror portion 37. The mirror portion 37 consists of a left side portion 37a and a right side portion 37b. The portions 37a and 37b have respectively reflective surfaces 38a and 38b of the shape of combined parabola and ellipse which is similar to that of the second embodiment. The first focus of each reflective surface 38a or 38b is located on the focus of the reflective surface 5 of the first reflective mirror portion 3, and the optical axes $x_a$—$x_b$—$x_b$ intersect with one another at the focus of the reflective surface 5 of the first reflective mirror portion 3, and the axis $x_a$—$x_a$ extends forward right direction and the axis $x_b$—$x_b$ extends forward left direction. Shown at numeral 39 in FIGS. 17 and 18 is a lens disposed in front of the reflective mirror 36.

The reflective mirror 36 makes the light distribution pattern as shown in FIG. 19, which comprises a first portion 40 formed by the first reflective mirror portion 3, and portions 41a and 41b. The portion 41a is formed by the left side portion 37a of the second reflective mirror portion 37 and the portion 41b is formed by the right side portion 37b of the second reflective mirror portion 37. Similar to the fourth emmbodiment, the second reflective mirror portion 37 of the fifth embodiment is divided into two portions 37a and 37b with the optical axes thereof intersecting with each other so that the horizontal extending portions of the light distribution pattern is further expanded.

The reflective surfaces of the portions 37a and 37b of the second reflective mirror portion 37 are not limited to the shape of combined parabola and ellipse, and may have any shape provided that the light reflected by the surfaces firstly converges on a vertically extending line and, thereafter, diverges in the left and right directions.

Figure 20:
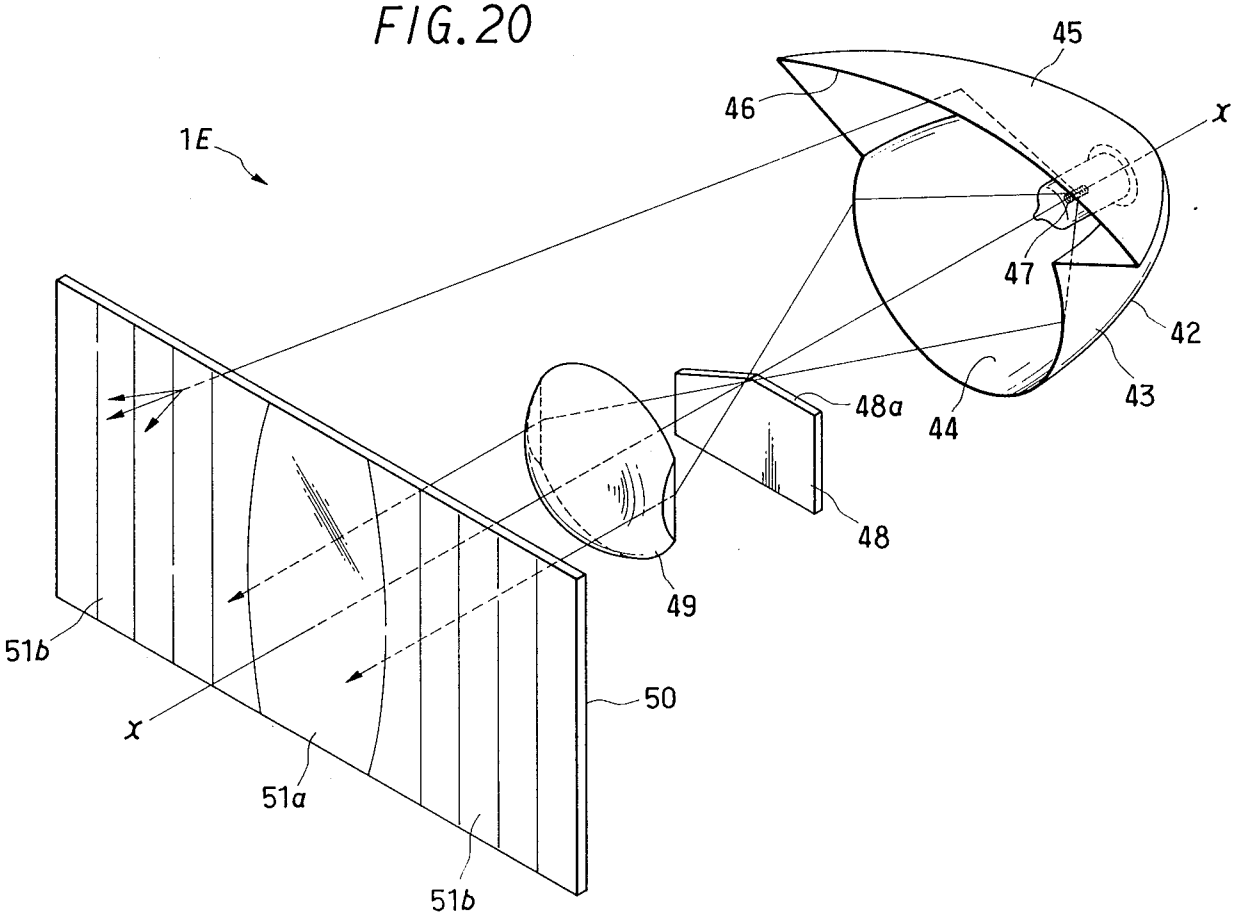
FIG. 20 is a schematic perspective view of a headlight device according to a sixth embodiment of the invention.
Figure 21:
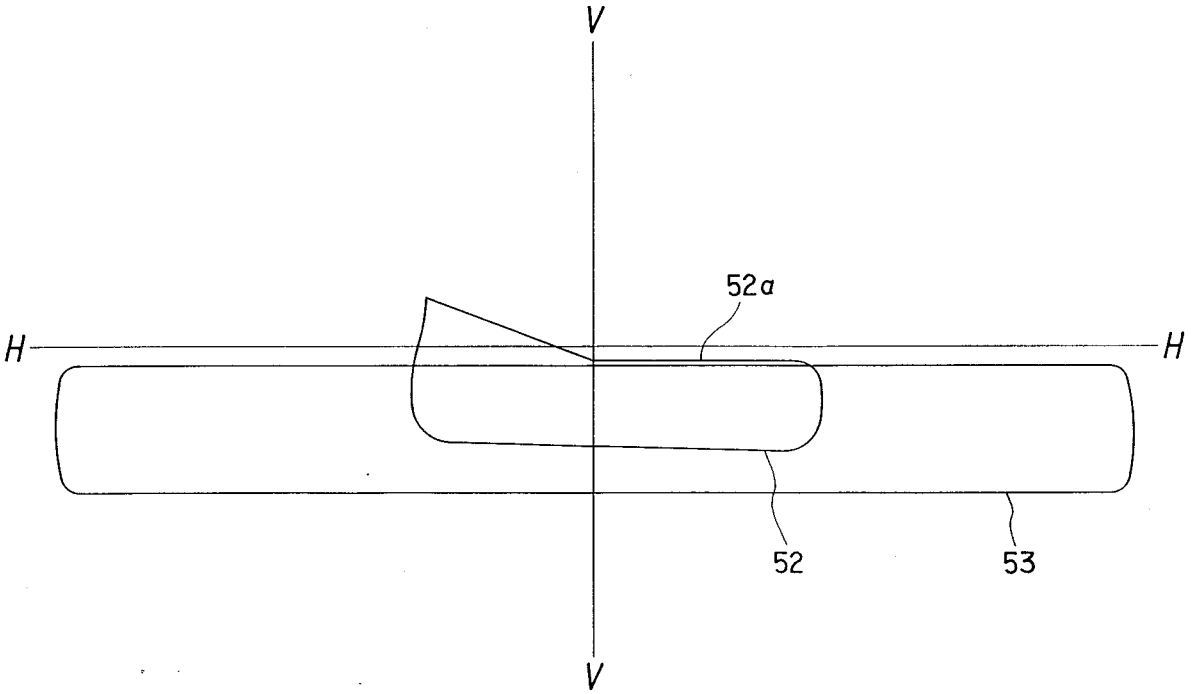
FIG. 21 is a view showing the light distribution pattern of the headlight device of FIG. 20.
Figure 22:
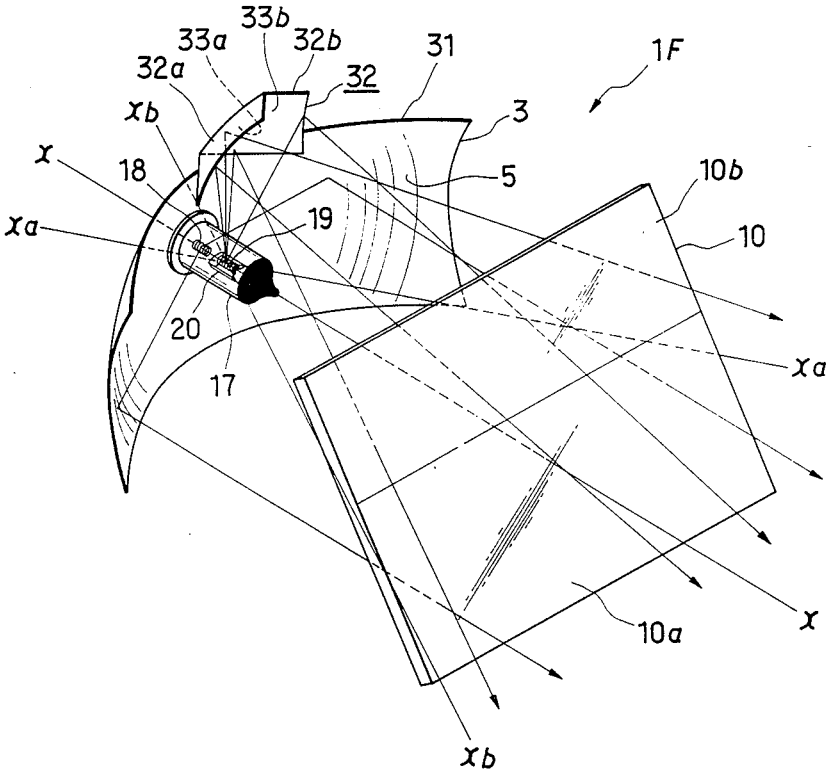
FIG. 22 is a schematic perspective view of a headlight according to a seventh embodiment of the invention.
Figure 23:
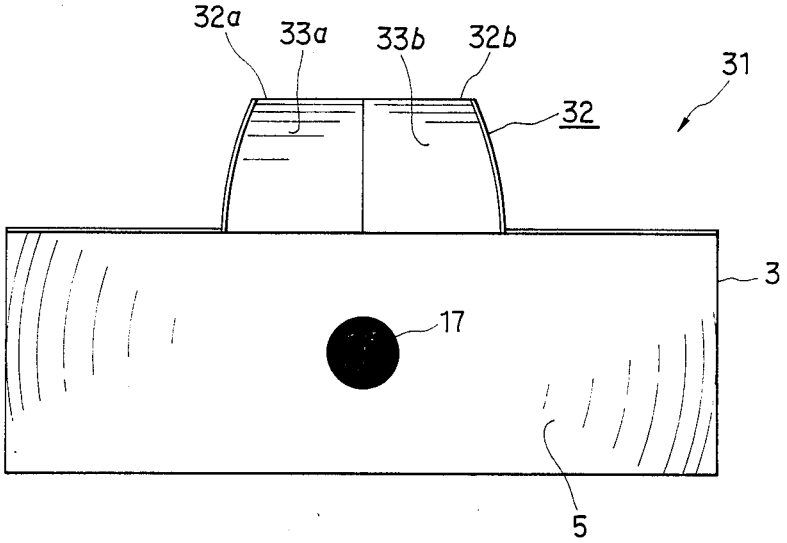
FIG. 23 is a front view of the reflective mirror of the embodiment of FIG. 22.

FIGS. 20 and 21 show the sixth embodiment 1E of the invention, which comprises a reflective mirror 42 consisting of a first reflective mirror portion 43 and a second reflective mirror portion 45.

The first reflective mirror portion 43 is formed to have a reflective surface 44 of the shape of ellipse of rotation, and the second reflective mirror portion 45 is located on the mirror portion 43 and the reflective surface 46 of the mirror portion 45 has the shape of combined parabola and hyperbola. The surface 46 of the second mirror portion 45 has the shape of hyperbola in the horizontal section and of parabola in the vertical section.

The focus of the reflective surface 46 of the second mirror portion 45 is nearly on the first focus of the reflective surface 44 of the first mirror portion 43.

A filament 47 is located nearly on the first focus of the reflective surface 44 of the first mirror portion 43.

A shade 48 and a projection lens 49 are disposed between the refective mirror 42 and a lens 50 as shown in FIG. 20. The shade 48 is located nearly on the second focus of the reflective surface 44 of the first mirror portion 43 and is adapted to cover a portion lower than the optical axis x—x, and the upper edge 48a of the shade 48 is inclined downward in the left half portion as viewed in FIG. 20, but the right half of the upper edge 48a is horizontal. The projection lens 49 is a convex lens with a focus thereof is nearly on the upper edge 48a of the shade 48.

The light emitted from the filament 47 and reflected by the reflective surface 44 tends to converge on the second focus of the reflective surface 44, and the lower portion of the light approaching the shade 48 is blocked by the shade. Thereafter, a generally parallel light beam is formed by the lens 49.

The lens 50 has a central portion 51a corresponding to the projection lens 49 and having no lens function, and side portions 51b and 51b with diverging steps being formed thereon for diverging the light passing through the lens 50.

According to the sixth embodiment 1E, the reflective mirror 42, the shade 48 and the projection lens 49 make a light distribution pattern as shown in FIG. 21, which comprises a pattern portion 52 formed by the first mirror portion 43, the shade 48 and the projection lens 49, and a pattern portion 53 formed by the reflective surface 46 of the second mirror portion 45. In the pattern portion 52, a line 52a is formed by the upper edge 48a of the shade 48.

FIG. 22 through FIG. 25 show the seventh embodiment 1F of the present invention, which comprises the reflective mirror 31 of the fourth embodiment 1C and the electric bulb 17 of the third embodiment 1B.

The filaments 18 and 19 of the bulb 17 are arranged along the optical axis x—x of the reflective surface 5, and the focus of the reflective surface 5 is between the main filament 18 and the sub-filament 19 and near to the main filament 18.

The positional relationship between the shade 20 and the reflective surface 5 of the first reflective mirror portion 3 is similar to that of the third embodiment 1B.

Figure 24:
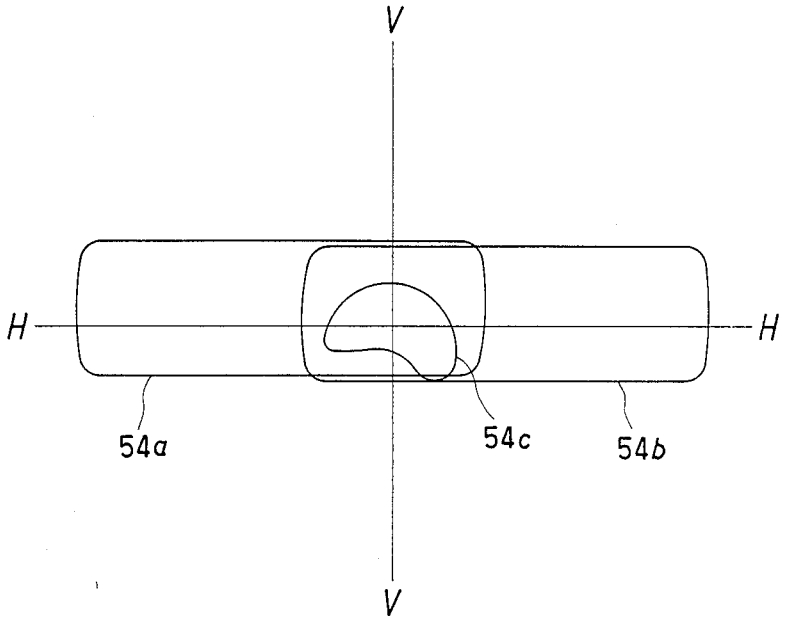
FIG. 24 is a view showing the light distribution pattern of the headlight device of FIG. 22.
Figure 25:
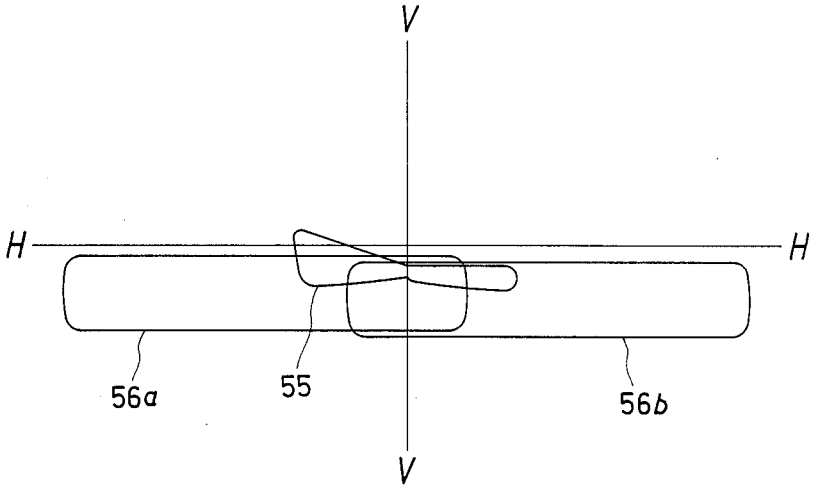
FIG. 25 is a view showing the light distribution pattern of a modified form of FIG. 24.

FIGS. 24 and 25 show the light distribution pattern of the reflective mirror 31 of the seventh embodiment 1F. Namely, FIG. 24 shows the light distribution pattern of the main filament 18, wherein a pattern 54a is made by the reflective surface 33a of the left side portion 32a of the second reflective mirror portion 32, a pattern 54b is made by the reflective surface 33b of the right side portion 32b of the second reflective mirror portion 32, and a pattern 54c is made by the reflective surface 5 of the first reflective mirror portion 3.

FIG. 25 shows the light distribution pattern when the sub-filament 19 is lit, which comprises, similarly to FIG. 24, a pattern 56a formed by the reflective surface 33a of the second mirror portion 32*a*, a pattern 56*b* which is formed by the right side reflective surface 33*b* of the second mirror portion 32*b*, and a pattern 55 which is formed by the reflective surface 5 of the first mirror portion 3.

As described heretofore in detail, the headlight device according to the invention comprises a reflective mirror which is divided into a first portion being effective to form a light distribution pattern of the central portion and a second portion being effective to form light distribution patterns of left and right side portions.

Thus, it is easy to obtain desired light distribution pattern, and to reduce a role of the lens in forming the light distribution pattern thereby simplifying the design of the lens and reducing the cost.

What is claimed is:

1. A headlight device for use in a vehicle and comprising a reflective mirror which is divided into a first portion being effective to form a light distribution pattern of the central portion, and a second portion being effective to form a light distribution pattern of the left and right side portions, said first portion having in a planar projection the shape of a rectangle elongated in a horizontal direction, said second portion being disposed adjacent a long side of said first portion, said first and second portions producing overlapping light distribution patterns in shapes determined substantially entirely by shapes of said first and second portions.

2. A headlight device as set forth in claim 1, wherein the first portion of the reflective mirror has the shape of paraboloid of rotation and the second portion of the reflective mirror has the shape of paraboloid in vertical section and that of straight line in horizontal section.

3. A headlight device as set forth in claim 1, wherein the first portion of the reflective mirror has the shape of paraboloid of rotation and the second portion of the reflective mirror has the shape of parabola in vertical section and that of ellipse in horizontal section.

4. A headlight device as set forth in claim 2, wherein the second portion of the reflective mirror is divided into left and right side portions which are arranged such that the light reflected by respective side portions intersect with one another.

5. A headlight device as set forth in claim 3, wherein the second portion of the reflective mirror is divided into left and right side portions which are arranged such that the light reflected by respective side portions intersect with one another.

6. A headlight device as set forth in claim 2, wherein the device further comprising an electric bulb having a main filament and a sub-filament which are arranged generally along the optical axis of the reflective mirror with the main filament being generally on the focus of the reflective mirror.

7. A headlight device as set forth in claim 4, wherein the device further comprising an electric bulb having a main filament and a sub-filament which are arranged generally along the optical axis of the reflective mirror with the main filament being near to the focus of the reflective mirror.

* * * * *

UNITED STATES PATENT AND TRADEMARK OFFICE

CERTIFICATE OF CORRECTION

PATENT NO. : 4,885,669

DATED : December 5, 1989

INVENTOR(S) : NINO

It is certified that error appears in the above-identified patent and that said Letters Patent is hereby corrected as shown below:

Cover Page, column 1, between the line starting "[22]" and the line starting "[51]", insert:

--[30] Foreign Application Priority Data

Oct. 28, 1987 [JP] Japan.....62-272570--

Signed and Sealed this

Eighth Day of January, 1991

*Attest:*

*Attesting Officer*

HARRY F. MANBECK, JR.

*Commissioner of Patents and Trademarks*